United States Patent [19]

Krause

[11] 4,230,795

[45] Oct. 28, 1980

[54] MULTIPART PHOTOSENSITIVE ELEMENT WITH BOTH FIXED CONTRAST AND VARIABLE CONTRAST PART RECORDS

[76] Inventor: Donald Krause, 8 Clintwood Dr., Apt. #8A, Brighton, N.Y. 14620

[21] Appl. No.: 33,378

[22] Filed: Apr. 26, 1979

Related U.S. Application Data

[63] Continuation-in-part of Ser. No. 847,583, Nov. 1, 1977, Pat. No. 4,175,967.

[51] Int. Cl.[3] ..... G03C 1/76; G03C 3/00

[52] U.S. Cl. ..... 430/503; 430/496; 430/591; 430/592; 430/502

[58] Field of Search ..... 96/68, 69, 27 R, 27 E; 430/503, 502, 591, 592, 496

[56] References Cited

U.S. PATENT DOCUMENTS

| | | | |
|---|---|---|---|
| 3,130,053 | 4/1964 | Hellmig | 96/69 |
| 3,140,179 | 7/1964 | Russell | 96/69 |
| 3,396,024 | 8/1968 | Hellmig et al. | 96/69 |
| 3,628,960 | 12/1971 | Philippaerts | 96/27 E |
| 3,839,036 | 10/1974 | Hellmig et al. | 96/27 E |
| 3,977,872 | 8/1976 | Hellmig | 96/69 |
| 3,992,210 | 11/1976 | Evans | 96/94 R |

*Primary Examiner*—Mary F. Downey

*Attorney, Agent, or Firm*—Joseph S. Iandiorio

[57] ABSTRACT

A multipart photosensitive element having a predetermined saturation density including at least two partial record portions for forming a full record, each partial record portion controlling a preselected density range of the full record; all of the partial record portions combining to produce the predetermined saturation density of the full record; at least one of the partial record portions including a fixed contrast emulsion and at least one of the partial record portions including a variable contrast emulsion for varying the contrast of that partial record portion over its preselected density range, each of the variable contrast emulsions being photoresponsive in a different spectral region from the other variable contrast emulsions in the other partial record portions for independently selectively varying the contrast in each of the partial record portions including a variable contrast emulsion.

11 Claims, 11 Drawing Figures

MULTIPART PHOTOSENSITIVE ELEMENT WITH BOTH FIXED CONTRAST AND VARIABLE CONTRAST PART RECORDS

RELATED CASE

This is a continuation in part of patent application Ser. No. 847,583, filed Nov. 1, 1977, now issued as U.S. Pat. No. 4,175,967 entitled "Multipart Photosensitive Element with Independent Contrast Control of Constituent Part Records", Donald Krause.

FIELD OF INVENTION

This invention relates to a multipart photosensitive element in which the contrast of at least one part record is independently controllable and in which the contrast of at least one part record is fixed.

BACKGROUND OF INVENTION

Variable contrast black and white photosensitive elements exist in which the overall contrast can be varied using different wavelengths of light. This is done by using various sensitizers in conjunction with silver halides to enable one range of wavelengths of exposing radiation to produce high contrast, another low, and yet another intermediate, for example. While the overall contrast can be modified in this way, parts of the sensitometric curve can not be independently altered. In applicant's co-pending patent application Ser. No. 847,583, a multipart photosensitive element comprising partial record portions, each of which includes a variable contrast emulsion, is disclosed. The present invention is directed toward a simpler and less costly element for use in less demanding applications. For example, in a strobe enlarger it is not easy to give extra exposure to highlight areas due to the short exposure duration. Reducing the contrast of the partial record emulsion associated with the density range of the highlights produces a similar result.

SUMMARY OF INVENTION

It is an object of this invention to provide an improved and a simpler multipart photosensitive element having independent contrast control of some of the constituent part records, the other constituent part records having fixed contrast.

The invention features a multipart photosensitive element having a predetermined saturation density. There are at least two partial record portions for forming a full record. Each of the partial record portions controls a preselected density range of a full record. All the partial record portions combine to produce the predetermined saturation density of the full record. At least one of the partial record portions includes a variable contrast emulsion photoresponsive as coated in a different spectral region from the other emulsions, for independently controlling contrast in the preselected density range associated with that partial record portion.

The emulsions may be each in a separate layer or all in a single layer if their effective sensitivity ranges are such that the fixed contrast emulsions have sensitivity where no variable contrast emulsion has sensitivity, and may have complementary or non-complementary speeds. If more than one partial record portion contains a variable contrast emulsion then the variable contrast emulsions must have substantially mutually exclusive sensitivity ranges in order to be all in a single layer. In the separate layer construction where the spectral regions of sensitivity of the emulsions may coincide, filter means may be inserted between these emulsions for attenuating radiation in at least a portion of the spectral range of one emulsion to which a second emulsion is also sensitive, in order to prevent that radiation from reaching the second emulsion.

The element may include a number of full records, as in a color film or color paper. One or more of these full records includes at least two partial record portions, as stated above. Each variable contrast emulsion in each full color record is photoresponsive in a different section of the spectral region associated with that color. If each of the variable contrast emulsions in a particular full record have mutually exclusive or substantially mutually exclusive photosensitive spectral sections, and if the fixed contrast emulsions have at least a portion of their sensitivity range where the variable contrast emulsions are insensitive, then these emulsions may be formed as a single layer. If not, they may be formed in separate layers with filter means between to split the light in that spectral region into separate sections to prevent exposure of subsequent emulsions by wavelengths which are meant to expose only the previous emulsion.

DISCLOSURE OF PREFERRED EMBODIMENT

Other objects, features, and advantages will occur from the following description of preferred embodiments and the accompanying drawings, in which.

Figure 1:
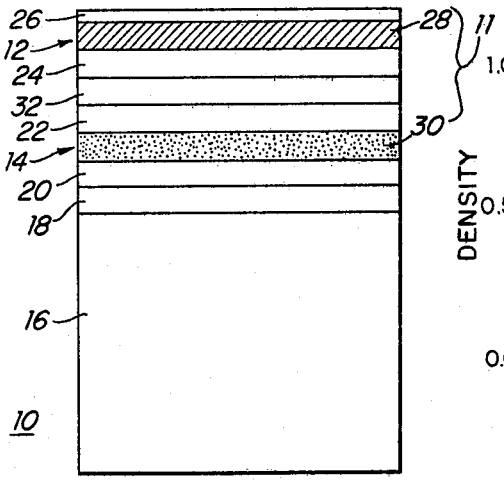
FIG. 1 is a diagram of a photosensitive element according to this invention.
Figure 11:
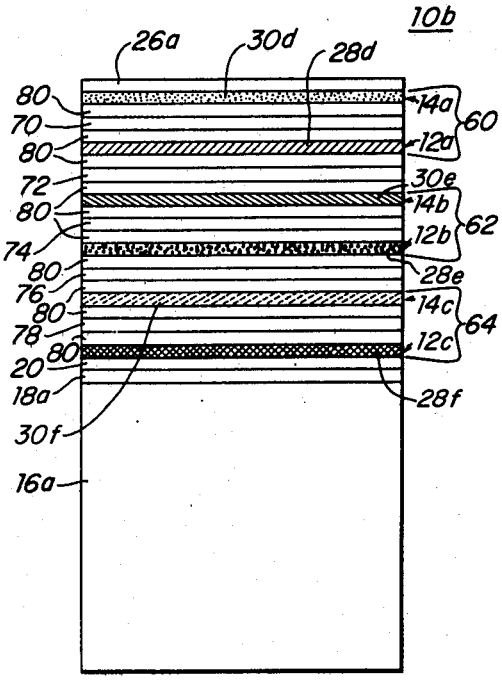
Figure 10:
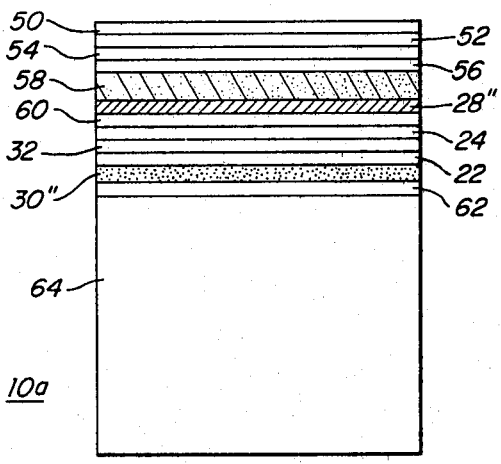

FIG. 10 is a diagram of a photosensitive element according to this invention similar to FIG. 1, showing the use of the invention in conjunction with a negative working dye transfer system; and FIG. 11 is a diagram of a photosensitive element according to this invention similar to FIG. 1, having three different full color records, one for the blue, one for the green, and one for the red records, each of which includes two partial records.

There is shown in FIG. 1 a photosensitive element 10; at least one full record 11 constituted by at least two or more part records 12 and 14; a support 16; baryta layer 18; and various spacer interlayers 20, 22, and 24, which may be of gelatin or of other similar materials used for making photographic emulsions; and a protective gelatin overcoat layer 26. Part record 12 includes emulsion 28, which may be formed of a fast blue-only sensitive silver halide, such as silver chloride, silver bromide, or silver chlorobromide, which have sensitivities in the range of approximately 360–410 nm, 375–470 nm, and some portion of the range from 360–470 nm, respectively. A blue sensitizer such as 5-(2-ethyl-1(2)-benzothiazolylidene)-3-n-heptyl-rhodanine is included in emulsion 28 in the usual way to condition the emulsion a variable contrast material, for example using the technique explained in U.S. Pat. No. 2,384,598. If emulsion 28 is a silver chloride emulsion, then two sensitizers must be added: one as above to condition it a variable contrast emulsion and another one to extend the high contrast of the region of inherent sensitivity further into the blue. A suitable sensitizer for this purpose would be 5-(2-ethyl-1(2)-benzothiazolylidene)-3-n-lauryl-2-thio-2,4 (3,5)-oxazoledione. Emulsion 28 typically has a saturation density between 0.3 and 1.2, with 0.7 to 1.0 being preferred.

Part record 14 includes emulsion 30, which may be formed of a slow, effectively red-light sensitive silver halide fixed contrast emulsion. The same silver halides may be used, but of smaller average crystal size. Included with them may be a red sensitizer, for example 5-[4-(2-ethyl-1(2)-benzothiazolylidene) butenylidene]-3-n-heptyl-rhodanine.

Even though emulsion 30 may have a sensitivity level in the blue region not substantially less than its level of sensitivity in the red spectral region, as is the case when this sensitizer is used for example, it has a different sensitivity range from emulsion 28 and therefore the optional spacer interlayers 22 and 24 and filter interlayer 32 may be omitted; in fact the two emulsions 28 and 30 may be formed as a single layer. Since emulsion 30 is a fixed contrast emulsion, it is not appreciably affected as to its contrast response by which portion of blue light is used for the exposure of variable contrast emulsion 28. Further, the relative speeds of emulsions 28 and 30 can be altered by altering the red to blue light ratio of the exposing light as explained below.

Figure 2:
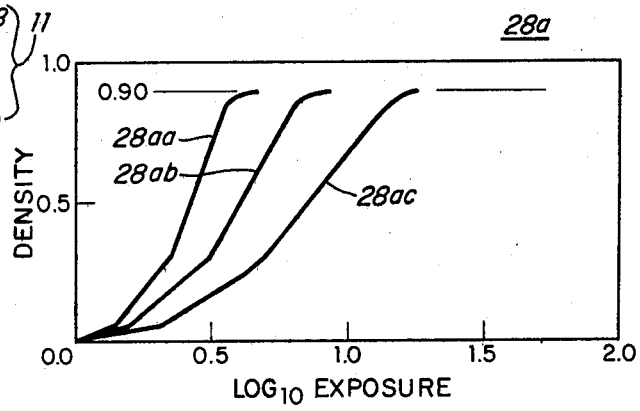
FIG. 2 is an illustration of the family of varying contrast D-log E curves of the fast blue-sensitive emulsion of FIG. 1.

A family of variable contrast curves 28*a*, FIG. 2, producible by emulsion 28, includes a high contrast curve 28*aa*, medium contrast curve 28*ab*, and low contrast curve 28*ac*. The exposure to obtain these curves is made in blue light. Their saturation densities are each 0.9. High contrast curve 28*aa* is made by exposure of emulsion 28 in short wavelengths of blue light only, for example such as by using a Kodak Polycontrast No. 4 filter. Exposure for medium contrast curve 28*ab* is made without a color filter so that both the shorter wavelength and longer wavelength of blue light to which emulsion 28 is sensitive is incident on element 10. Exposure to produce low contrast curve 28*ac* is produced by using predominately long wavelength blue light along with some short wavelength blue light as well, such as by using a Wratten 6 filter.

Figure 3:
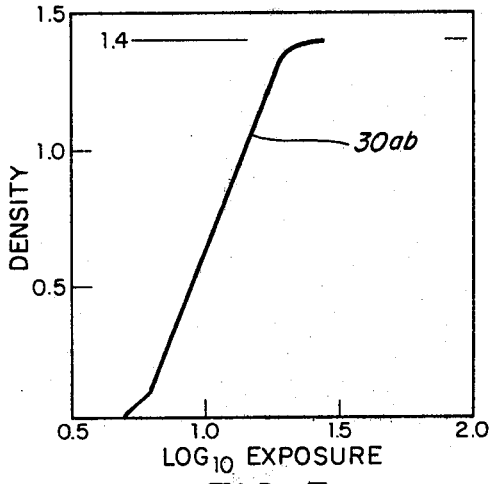
FIG. 3 is an illustration of the fixed contrast D-log E curve of the slow red-sensitive emulsion of FIG. 1.

The fixed contrast D-log E curve 30*ab* producible by emulsion 30 is shown in FIG. 3. This curve is obtained by exposing element 10 to red and blue light. The saturation density of this curve is shown to be 1.4.

Thus each of the emulsions 28 and 30 may form a part record so that the part containing emulsion 28 may have any contrast range as illustrated by curve 28*aa*, 28*ab*, and 28*ac*; while the second part record of the full record formed by emulsion 30 may have the fixed contrast curve as indicated by curve 30*ab*.

Figure 4:
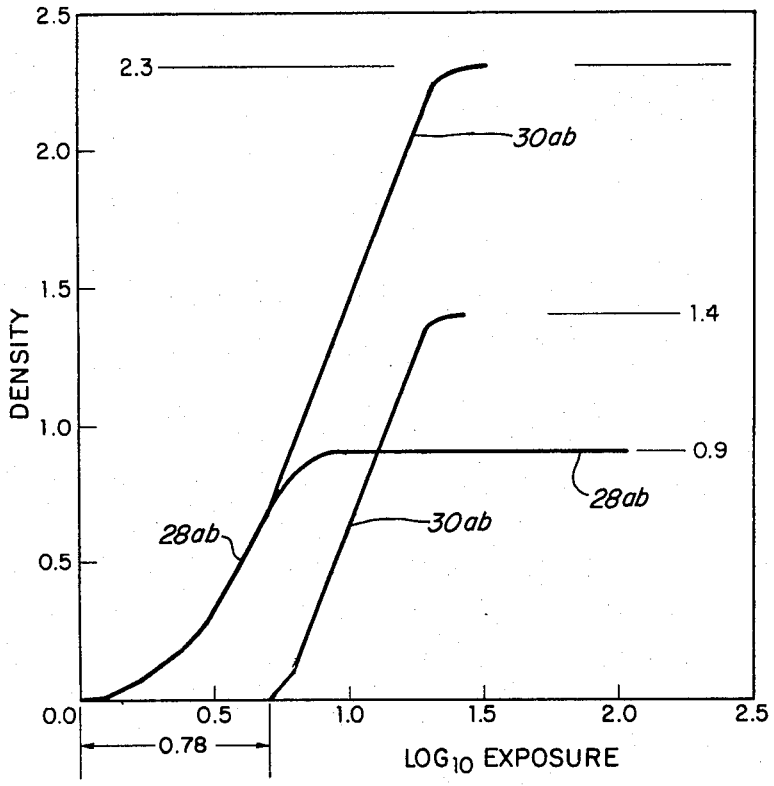
FIG. 4 is an illustration of the D-log E curve of FIG. 3, combined with the medium contrast curve of FIG. 2.
Figure 5:
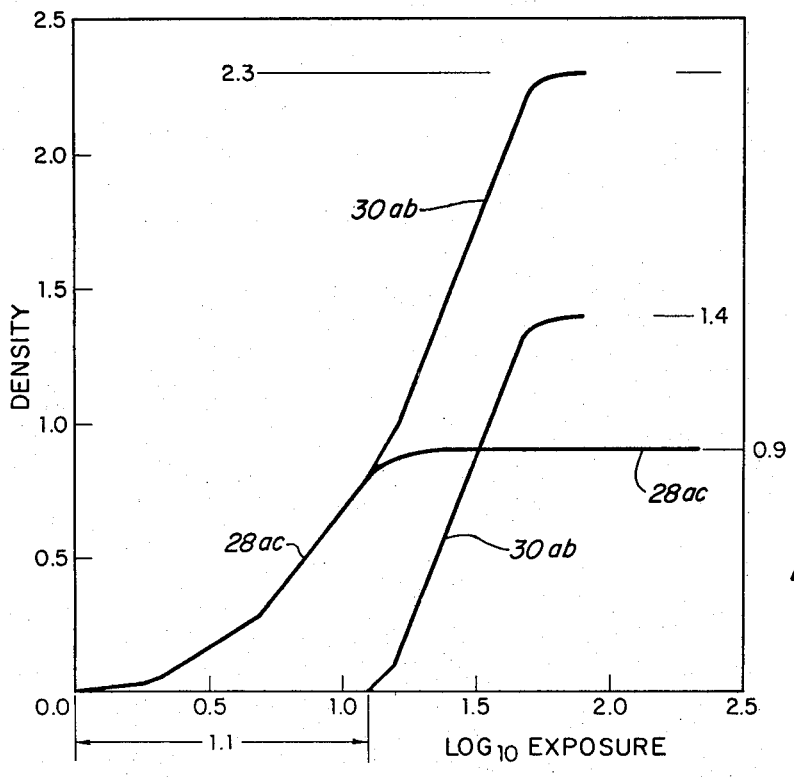
FIG. 5 is an illustration of the D-log E curve of FIG. 3, combined with the low contrast curve of FIG. 2.
Figure 6:
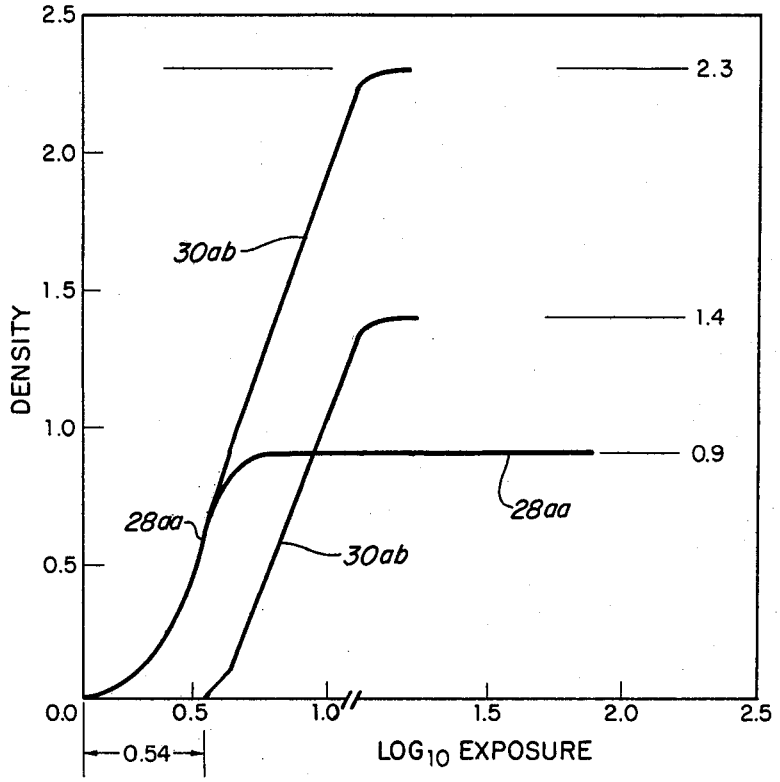
FIG. 6 is an illustration of the D-log E curve of FIG. 3, combined with the high contrast curve of FIG. 2.

Thus a full record provided by photosensitive element 10 utilizing part records formed of emulsions 28 and 30 may provide either a medium contrast in the white and gray areas as indicated by medium contrast curve 28*ab*, FIG. 4, a low contrast in the whites and gray areas as indicated by curve 28*ac*, FIG. 5, or a high contrast in the whites and gray areas as indicated by curve 28*aa*, FIG. 6, each together with a fixed contrast curve 30*ab* in the black area for a black and white reproduction. The photosensitive element 10 in this example has a preselected saturation density of 2.3 as a result of the accumulation of the 0.9 density of emulsion 28, and the 1.4 density of emulsion 30.

In FIG. 4 the toe of curve 30*ab* begins at about 0.78 log exposure, which coincides with the boundary density of 0.80 of medium contrast curve 28*aa*, and no adjustment is therefore necessary.

However, as shown in FIG. 5, when the low contrast range indicated by curve 28*ac* is chosen, the curve 30*ab* must be shifted from its 0.78 log exposure position to a 1.1 log exposure position in order that it properly meet the 0.8 boundary density of curve 28*ac*.

Similarly, as shown in FIG. 6, if the high contrast range indicated by curve 28*aa* is selected, the curve 30*ab* must be shifted to the 0.54 log exposure point in order to properly match the boundary density of curve 28*aa* at 0.8. The shifting of the curve 30*ab* is accomplished with filtration of the exposing light. Thus in FIG. 5 for matching the curve 30*ab* with the low contrast curve 28*ac*, a red blocking filter such as a blue or cyan Kodak color correction filter, is used to further slow down the response of the curve 30*ab*, and move it from the 0.78 to 1.1 position of the log exposure range.

Conversely, with respect to FIG. 6, a blue blocking filter, such as for example a red Kodak color correction filter, may be used to slow down the speed of the faster emulsion 28*a*.

Figure 7:
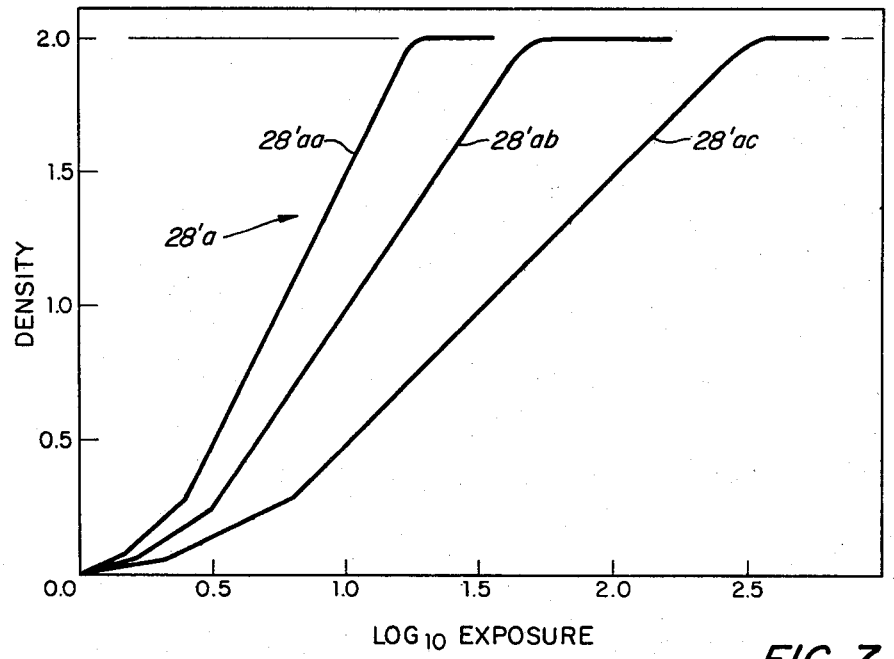
FIG. 7 is an illustration of the family of varying contrast D-log E curves of a fast blue-sensitive non-complementary speed emulsion shown in FIG. 1.
Figure 8:
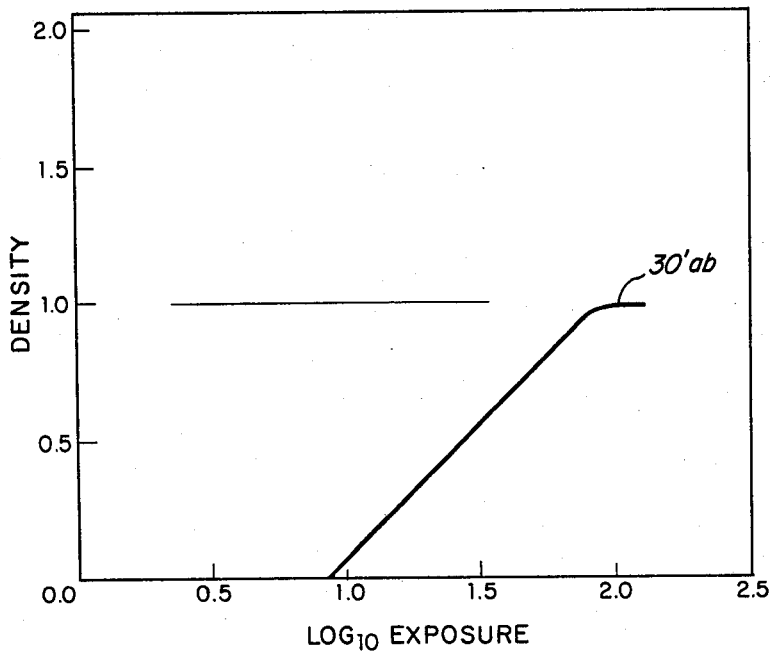
FIG. 8 is an illustration of the fixed contrast D-log E curve of a slow red-sensitive non-complementary speed emulsion shown in FIG. 1.
Figure 9:
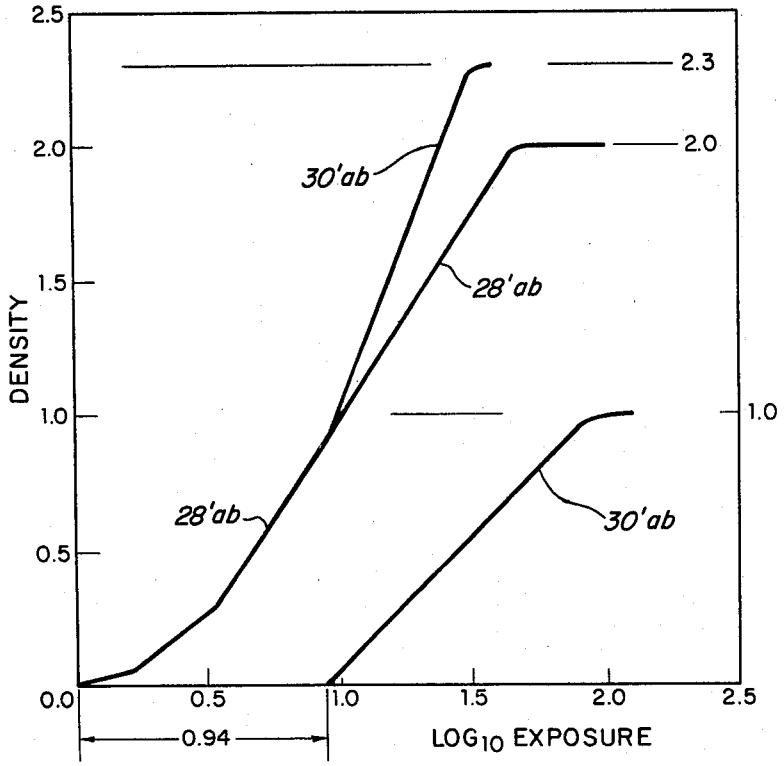
FIG. 9 is an illustration of the D-log E curve of FIG. 8, combined with the medium contrast curve of FIG. 7.

Although thus far the invention has been described solely with respect to emulsions having complementary speeds, this is not required and is not a necessary limitation of the invention, as they may be non-complementary as well. For example, emulsion 28 may have a saturation density of 2.0 so that it provides a family of curves 28'*a*, as shown in FIG. 7, and emulsion 30 may be formed to provide a fixed contrast curve 30'*ab* as shown in FIG. 8. Thus when combined to obtain the medium contrast range for the grays and whites as indicated by curve 28'*ab*, the preselected total density of the full record remains at 2.3, due to the surface reflection limit of 2.3 for a glossy paper, being discussed here; but the sum of the slopes remains constant until the reflection density of 2.3 is attained. This is due to the addition of curve 28'*ab* up to the 2.0 density point with curve 30'*ab*. Curve 28'*ab* reaches saturation density after the accumulated density curve 30'*ab*. This is shown in FIG. 9. Combination with the high and low contrast ranges indicated by curves 28'*aa* and 28'*ac* occurs in a similar fashion.

Although thus far the upper layer shown in FIG. 1 embodies the emulsion 28 fast blue-only light sensitive variable contrast material and the lower layer embodies the emulsion 30 slow red-sensitive fixed contrast material, this is not necessarily a limitation of the invention. For example, the upper layer may be red-sensitive and the lower layer blue-sensitive; and the upper may be slow and the lower fast, the lower layer variable contrast and the upper layer fixed contrast, with whatever filtration, if any, is necessary, if the spectral regions of sensitivity overlap.

For example, the upper layer emulsion 28 may be a slow fixed contrast pan emulsion and the lower layer emulsion 30 may be a fast variable contrast emulsion also sensitive to all colors of light but producing a first contrast response in green light and a second contrast response in red light. In this case a yellow filter interlayer 32 may be placed between emulsions 28 and 30 to block blue light from reaching emulsion 30 so that the relative speeds of the two emulsions can be adjusted by yellow and blue filtration of the exposing light. Interlayer 32 may be a filter made using together the antihalation dyes of formula 8 and formula 5 of U.S. Pat. No. 3,544,325. Spacer interlayers 22 and 24 may also be used.

The invention applies to positive or reversal elements as well as negative elements illustrated herein, and to both so-called wet process photosensitive elements and dry process photosensitive elements, including diffusion transfer process dye transfer systems such as Polaroid films. For example, in FIG. 10 there is shown a photosensitive element 10*a* which includes emulsion 28″ and emulsion 30″ with any necessary spacer interlayers 22, 24, and filtration 32, in conjunction with generally conventional materials used in such dye transfer systems; e.g. transparent support layer 50, polymeric acid layer 52, timing layer 54, image receiving layer 56, a layer 58 including a processing composition having opacifying dyes during processing and a white background material after processing is completed; and two black dye layers 60, 62, on an opaque support 64. A similar negative working system is explained in U.S. Pat. Nos. 3,443,939 and 3,751,406.

While thus far the invention has been illustrated by a photosensitive element depicting only one full record including but two part records, this is not a necessary limitation of the invention. There may be more than one full record and each full record may contain two or more such part records, provided that they are made different as to their sensitivity. The fixed contrast emulsions should all have at least a portion of their sensitivity range where none of variable contrast emulsions are sensitive, as coated. The variable contrast emulsions should be made generally, or at least effectively, mutually exclusive as to their sensitivity. There may be as many different part records including a variable contrast emulsion as there are desired number of distinct density ranges which are desired to have their contrast controlled. Thus, for example, a three-part full record with two part records including variable contrast emulsions might give separate contrast control over the whites and blacks, with fixed contrast for the grays, while a five-part record with two part records including variable contrast emulsions might give contrast control over the whites and blacks with up to three different fixed contrasts for the light, midtone and dark grays.

For example, a three-part full record with two part records including variable contrast emulsions may comprise a fast blue-only variable contrast emulsion, a medium speed blue and green sensitive fixed contrast emulsion, and a slow red and blue sensitive variable contrast emulsion. The medium speed fixed contrast emulsion could be formed with either of the other two emulsions as a single layer. The layer including the slow red and blue sensitive variable contrast emulsion would be coated underneath the layer including the fast blue-only sensitive variable contrast emulsion. A yellow filter layer may be coated intermediate these two layers. If, however, the slow red and blue sensitive layer had negligible blue sensitivity, then the yellow filter layer and the associated spacer interlayers may be omitted, and in fact all the emulsions may be formed as a single layer.

One example of an element using more than one full record is a color photosensitive element 10*b*, FIG. 11, using three full records, one for each of the primary image colors blue, green and red.

Each of the full records 60, 62, 64, includes at least two part records 12*a*, 14*a*; 12*b*, 14*b*; 12*c*, 14*c*. Part record 12*a* includes a fast blue variable contrast emulsion 28*d* having effective sensitivity from about 400 nm to 500 nm; and a slow blue fixed contrast emulsion 30*d* is included in part record 14*a* having effective sensitivity in some portion of the range 360 nm to 470 nm. Part record 12*b* includes a fast green variable contrast emulsion 28*e* having effective sensitivity from about 400 nm to 600 nm, and slow green fixed contrast emulsion 30*e* is included in part record 14*b* having effective sensitivity from about 390 nm to 540 nm. Part record 12*c* includes a fast red variable contrast emulsion 28*f* having effective sensitivity from about 380 nm to 715 nm, and slow red fixed contrast emulsion 30*f* having effective sensitivity from about 420 nm to 500 nm, and from about 560 nm to 660 nm is included in part record 14*c*. Emulsions 28*d* and 30*d*, 28*e* and 30*e*, 28*f* and 30*f* are sensitive in the areas of the spectrum associated with the color of the full record to which they contribute. If each pair of emulsions sensitive to the same general color are different so that at least a portion of the sensitivity range of the fixed contrast emulsion lies outside the sensitivity range of the variable contrast emulsion in their sensitivity within that region, then pairs may be made up as a monolayer instead of requiring a multilayer construction. The three fast emulsions should have the same effective photographic speed and whatever slope is chosen for them should be the same. This also applies to the slow emulsions although in this case the slopes are fixed at the time of the manufacture and may be different from any of the possible slopes that can be chosen for the fast emulsion.

As explained previously, added to each of the variable contrast emulsions are the necessary sensitizers: one for the purpose of extending the high contrast of the region of inherent sensitivity into the appropriate spectral region; the other sensitizer for the purpose of conditioning the emulsion for variable contrast. The fixed contrast emulsions are sensitized in the ordinary manner as needed.

For example, the sensitizing dye used in emulsion 28*d* to extend the high contrast of the region of inherent sensitivity into the longer wavelengths of blue light may be 5-(2-ethyl-1 (2)-benzothiazolylidene)-3-n-heptylrhodanine. The sensitizing dye used in emulsion 28*d* to condition it for variable contrast may be 3-carboxymethyl-1-(3-sulfopropyl)-oxa-2′-cyanine betanine.

No sensitizing dye need be used with fixed contrast emulsion 30*d* as silver chloride, silver chlorobromide, and silver bromide are inherently sensitive to blue and/or violet light. Its region of inherent sensitivity would be used for fixed contrast. This emulsion would be a silver chloride, a silver chlorobromide, or silver bromide emulsion.

The sensitizing dye used in emulsion 28*e* to extend the high contrast of the region of inherent sensitivity into green light may be 5-[(2-ethyl-1(2)-benzothiazolylidene)-ethylidene]-3-n-heptyl-1-phenyl-2-thiohydantoin. The sensitizing dye used in emulsion 28*e* to condition it for variable contrast may be 5,5', 6,6'-tetrachloro-1,1'-diethyl-3,3'-bis(γ-sulfopropyl) benzimidazolocarbocyanine betaine sodium salt.

The sensitizing dye used in emulsion 30*e* to confer sensitivity to green light may be 2-methyl-1'-ethylthia-2'-cyanine iodide. Emulsion 30*e* has fixed contrast as noted above.

The sensitizing dye used in emulsion 28*f* to extend the high contrast of the region of inherent sensitivity into the red may be dye III-G of U.S. Pat. No. 3,907,575. [The structural formula for this dye is given on columns 15 and 16 of that patent.] The sensitizing dye used to condition emulsion 28*f* for variable contrast may be 3,3'-diethyl-9-(3-pyrryl)-4,5,4', 5'-dibenzothiacarbocyanine bromide.

The sensitizing dye used to confer on emulsion 30*f* sensitivity to the red may be dye 2 of U.S. Pat. No. 3,918,979. The structural formula for this dye is given on columns 3 and 4 of that patent. Emulsion 30*f* as noted above has fixed contrast.

Photosensitive element 10*b*, as shown, includes a blue splitting filter 70 for separating the blue spectral region for preventing, for example, light in the shorter wavelengths of blue to which emulsion 30*d* is sensitive from reaching and interfering with emulsion 28*d*, which is to record only in a longer wavelength blue light but is nonetheless sensitive to the shorter wavelength blue light. This may be a filter made using the antihalation dye of formula 1 of U.S. Pat. No. 3,687,670. The structural formula for this dye is given on column 3 of that patent. A filter can be made using this dye so that it effectively blocks light in the wavelengths from about 380 nm to 455 nm. Between the first full record 60 and the second full record 62 is a yellow filter 72 which effectively blocks blue light which is no longer needed for the creation of the remaining part records of the full records 62 and 64, but to which those part records' emulsions may be sensitive. This may be a filter made using together the anti-halation dye of formula 8 and the dye of formula 5, both of U.S. Pat. No. 3,544,325. The structural formulae for both dyes are given on column 4 of that patent. A filter can be made using these dyes so that it effectively blocks light in the wavelengths from about 380 nm to 500 nm. A green splitting filter 74 is provided between the green full record 62 emulsions 28*e* and 30*e* for the same purpose as the blue splitting filter 70, as explained above. This may be a filter made using the anti-halation dye of formula 2 of U.S. Pat. No. 3,544,325. The structural formula for this dye is given on column 3 of that patent. A filter can be made using this dye so that it effectively blocks light in the wavelengths from about 380 nm to 550 nm.

Similarly, a magenta or red filter 76 is provided above red full record 64 in order to effectively block any blue or green light which is no longer necessary from reaching emulsions 28*f* and 30*f*, which might nonetheless be sensitive to that light. This may be a filter made using the antihalation dye of formula 3 of U.S. Pat. No. 3,471,293. The structural formula for this dye is given in column 2 of that patent. A filter can be made using this dye so that it effectively blocks light in the wavelengths from about 450 to 610 nm. A red splitting filter 78 is used between the red-sensitive emulsions 28*f* and 30*f* for the same purpose as the previous splitting filters were used between their respective part records. This may be a filter made using the antihalation dye of formula 4 of U.S. Pat. No. 3,471,293. The structural formula for this dye is given in column 3 of that patent. This dye strongly blocks light in the wavelengths from about 600 nm to 665 nm. A filter can be made using this dye so that it effectively blocks light in wavelengths less than 665 nm from exposing emulsion 28*f*. Various spacer interlayers 80 are used as necessary.

If instead of the sensitizer listed above for emulsion 28*d* for the purpose of conditioning it a variable contrast emulsion, Compound 3 of U.S. Pat. No. 3,847,613, whose structural formula is shown in column 2 of that patent, had been used together with 5-(2-ethyl-1(2)-benzothiazolylidene)-3-n-heptylrhodanine to extend the high contrast of the region of inherent sensitivity into the longer wavelengths of the blue, then emulsions 28*d* and 30*d* may be formed as a single layer. In this case, layer 70, the blue splitting filter, and the associated spacer interlayers 80 would be omitted. The reason this is possible is layer 28*d* with these two sensitizers has little effective sensitivity below 435 nm when compared with its sensitivity between 435 nm and 500 nm. It will be clear that in this case the sensitivity range of variable contrast emulsion 28*d* may overlap with that of fixed contrast emulsion 30*d*. Fixed contrast emulsion 30*d* is, however, sensitive to wavelengths shorter than 435 nm where variable contrast emulsion 28*d* is substantially insensitive.

If instead of the sensitizer listed above for emulsion 28*e* for the purpose of extending the high contrast of the region of inherent sensitivity into green light the following sensitizing dye had been used, then with no other changes in the sensitizers in emulsions 28*e* and 30*e*, emulsions 28*e* and 30*e* may be formed as a single layer. This replacement sensitizing dye may be 5,5', 6,6'-tetrachloro-1,1',3,3'-tetraethylbenzimidazolocarbocyanine iodide. In this case, emulsion layer 28*e* has effective sensitivity only in two spectral regions: approximately 400–470 nm and 550–600 nm. Since filter layer 72 effectively blocks blue light from reaching green full color record 62, emulsions 28*e* and 30*e* may be formed as a single layer. In this case, layer 74, the green splitting filter, and the associated spacer interlayers 80 would be omitted. While in this case the sensitivities of emulsions 28*e* and 30*e* are to mutually exclusive sections of the green spectral region, this is not required as noted above. All that is required is that the fixed contrast emulsion have a portion of its sensitivity range where the variable contrast emulsion is substantially insensitive.

If instead of the sensitizer listed above for emulsion 28*f* that conditioned it for variable contrast the following sensitizing dye had been used, then with no other changes in the sensitizer dyes used in emulsions 28*f* and 30*f*, emulsions 28*f* and 30*f* may be formed as a single layer. This replacement sensitizing dye is 5-[4-(2-ethyl-1(2)-benzothiazolylidene) butenylidene]-3-n-heptylrhodanine. In this case emulsion layer 28*f* has effective sensitivity only in two spectral regions: approximately 370 nm to 470 nm and 650 nm to 715 nm. Since filter layer 72 effectively blocks blue light from reaching red full color record 64 as well, emulsions 28*f* and 30*f* may be formed as a single layer. In this case, layer 78, the red splitting filter, and the associated spacer interlayers 80 would be omitted. In this case it will be clear that there is some overlap of the two sensitivity ranges. Nonetheless, the two emulsions may be formed together because the fixed contrast emulsion is sensitive where the variable contrast emulsion is substantially insensitive.

Clearly, the use of the techniques of U.S. Pat. No. 2,384,598 has been illustrative and not limiting. Other techniques to make the constituent emulsions variable contrast emulsions can be used as well.

Other embodiments will occur to those skilled in the art and are within the following claims:

What is claimed is:

1. A multipart photosensitive element comprising: a support, a plurality of partial record portions carried on said support; all of said partial record portions together forming a full record; each of said partial record portions having a preselected density range of said full record and all of said partial record portion densities combined forming the total density range of said full record; at least one of said partial record portions including a fixed contrast emulsion and at least one of said partial record portions including a variable contrast emulsion for varying the contrast of that partial record portion over its preselected density range; each of said variable contrast emulsions being photoresponsive in a different spectral region from the other variable contrast emulsions in the other partial record portions for independently selectively varying the contrast in each of the partial record portions including variable contrast emulsions.

2. The multipart photosensitive element of claim 1 in which said emulsions are each in a separate layer.

3. The multipart photosensitive element of claim 1 in which more than one of said emulsions are formed in a single layer.

4. The multipart photosensitive element of claim 1 in which said emulsions have complementary speeds.

5. The multipart photosensitive element of claim 1 in which said emulsions have non-complementary speeds.

6. The multipart photosensitive element of claim 2 in which the spectral regions of the sensitivity of a first of said emulsions overlaps with a second and said element further includes filter means between said emulsions for attenuating radiation in a portion of the spectral range of said first emulsion to which said second emulsion is also sensitive before that radiation reaches said second emulsion.

7. The multipart photosensitive element of claim 1 in which said element includes a number of different color full records each having said at least two partial record portions.

8. The multipart photosensitive element of claim 7 in which a fixed contrast emulsion in at least one color full record is photoresponsive in a section of the spectral region associated with that color, said section being at least in part outside the corresponding spectral section associated with a variable contrast emulsion contained in said at least one color full record.

9. The multipart photosensitive element of claim 7 in which each emulsion in each different color full record is photoresponsive in a section of the spectral region associated with that color.

10. The multipart photosensitive element of claim 7 in which each of said emulsions of a said full record is in a separate layer, and said element further includes filter means disposed between said emulsions in a full color record for attenuating radiation in a portion of the section of the spectral range of a first of said emulsions to which a subsequent emulsion is also sensitive before that radiation reaches that subsequent emulsion.

11. A multipart photosensitive element comprising: a support; first and second partial record portions carried on said support and together forming a full record; each of said partial record portions having a preselected density range of said full record and all of said partial record portion densities combined forming the total density range of said full record; at least one of said partial record portions including a variable contrast emulsion for varying the contrast of that partial record portion over its preselected density range; and at least one of said partial record portions including a fixed contrast emulsion; said variable contrast partial record portion emulsion including silver bromide and 5-(2-ethyl-1(2)-benzothiazolylidene)-3-n-heptyl-rhodanine as a sensitizer; and said fixed contrast partial record portion emulsion including silver bromide and 5-[4-(2-ethyl-1(2)-benzothiazolylidene) butenylidene]-3-n-heptylrhodanine as a sensitizer.

* * * * *